US006874460B2

(12) United States Patent
Duwel

(10) Patent No.: US 6,874,460 B2
(45) Date of Patent: Apr. 5, 2005

(54) INTEGRATED OIL PAN AND WINDAGE TRAY

(75) Inventor: Jeffrey Alan Duwel, Plymouth, MI (US)

(73) Assignee: Fraudenberg-NOK General Partnership, Plymouth, MI (US)

( * ) Notice: Subject to any disclaimer, the term of this patent is extended or adjusted under 35 U.S.C. 154(b) by 0 days.

(21) Appl. No.: 10/792,554

(22) Filed: Mar. 3, 2004

(65) Prior Publication Data

US 2004/0177826 A1 Sep. 16, 2004

Related U.S. Application Data

(60) Provisional application No. 60/454,274, filed on Mar. 13, 2003.

(51) Int. Cl.[7] ..... F01M 1/00
(52) U.S. Cl. ..... 123/196 R; 29/888.01
(58) Field of Search ..... 123/196 R, 195 C; 29/888.01, 888.011, 888.3

(56) References Cited

U.S. PATENT DOCUMENTS 4,911,118 A * 3/1990 Kageyama et al. ..... 123/195 H

* cited by examiner

*Primary Examiner*—Andrew M. Dolinar
*Assistant Examiner*—Katrina B. Harris
(74) *Attorney, Agent, or Firm*—Ronald W. Wangerow; Harness, Dickey & Pierce, P.L.C.

(57) ABSTRACT

An oil pan gasket/windage tray for an engine having an engine block and an oil pan is provided and includes a tray adapted for installation between the engine block and the oil pan and the tray having a body with a peripheral flange extending about the periphery of the body and at least one deflector portion extending away from the body to a location spaced away from the peripheral flange. The deflector portion is integrally formed with the body from a single piece of sheet material and a separate peripheral flange portion is provided adjacent to the deflector portion and is affixed to a remainder of the peripheral flange to form the complete gasket flange portion of the oil pan gasket and windage tray system.

10 Claims, 6 Drawing Sheets

INTEGRATED OIL PAN AND WINDAGE TRAY

PRIORITY CLAIM

This application claims priority from U.S. Provisional Application No. 60/454,274, filed Mar. 13, 2003.

FIELD OF THE INVENTION

The present invention relates to an oil pan gasket and windage tray for an engine, and more particularly to an improved construction thereof and method of making.

BACKGROUND OF THE INVENTION

Typical automobile engines include a crank case and an oil pan mounted to the crank case and having a gasket disposed between the oil pan and crank case. Recently, a windage tray feature has been added to the oil pan gasket as a single assembly. The windage tray blocks air and oil turbulence which is caused by the rotating crankshaft from interacting with air and oil which resides in the bottom of the oil pan. As illustrated in FIG. 1, a prior art oil pan gasket and windage tray 100 is shown and includes a main body portion 102 which is stamped from sheet metal. A rubber perimeter seal 104 is molded around the perimeter flange 106 of the main body portion 102. A separate stamped plate 108 including a pair of deflector portions 110 is assembled to the main body portion 102. Because of the length of deflector portions 110 which extend beyond the flange 106 of the main body portion 102, the separate stamped plate 108 is required to be stamped as a separate plate and attached to the main body portion 102. The deflector portions 110 are specifically designed to wrap partially around and come in close proximity to the crankshaft (not shown) in order to deflect oil and air turbulence in the vicinity of the crankshaft. Although the current design of the oil pan gasket and windage tray 100 is sufficient for its purposes, it is desirable to provide an oil pan gasket and windage tray design that is less expensive and easier to produce.

SUMMARY OF THE INVENTION

The present invention provides a combined oil pan gasket and windage tray in which the deflector portions are integrated into the main stamped body of the pan and separate peripheral flange portions are formed and mounted to the remainder of the peripheral flange. The separate peripheral flange portions can be affixed to the remainder of the peripheral flange by an elastomeric sealing bead overlying and sealingly affixed to at least one side of the remainder of the peripheral flange and of the separate peripheral flange portion in order to maintain the separate peripheral flange portion in an aligned and generally coplanar relationship with the remainder of the peripheral flange.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

Figure 1:
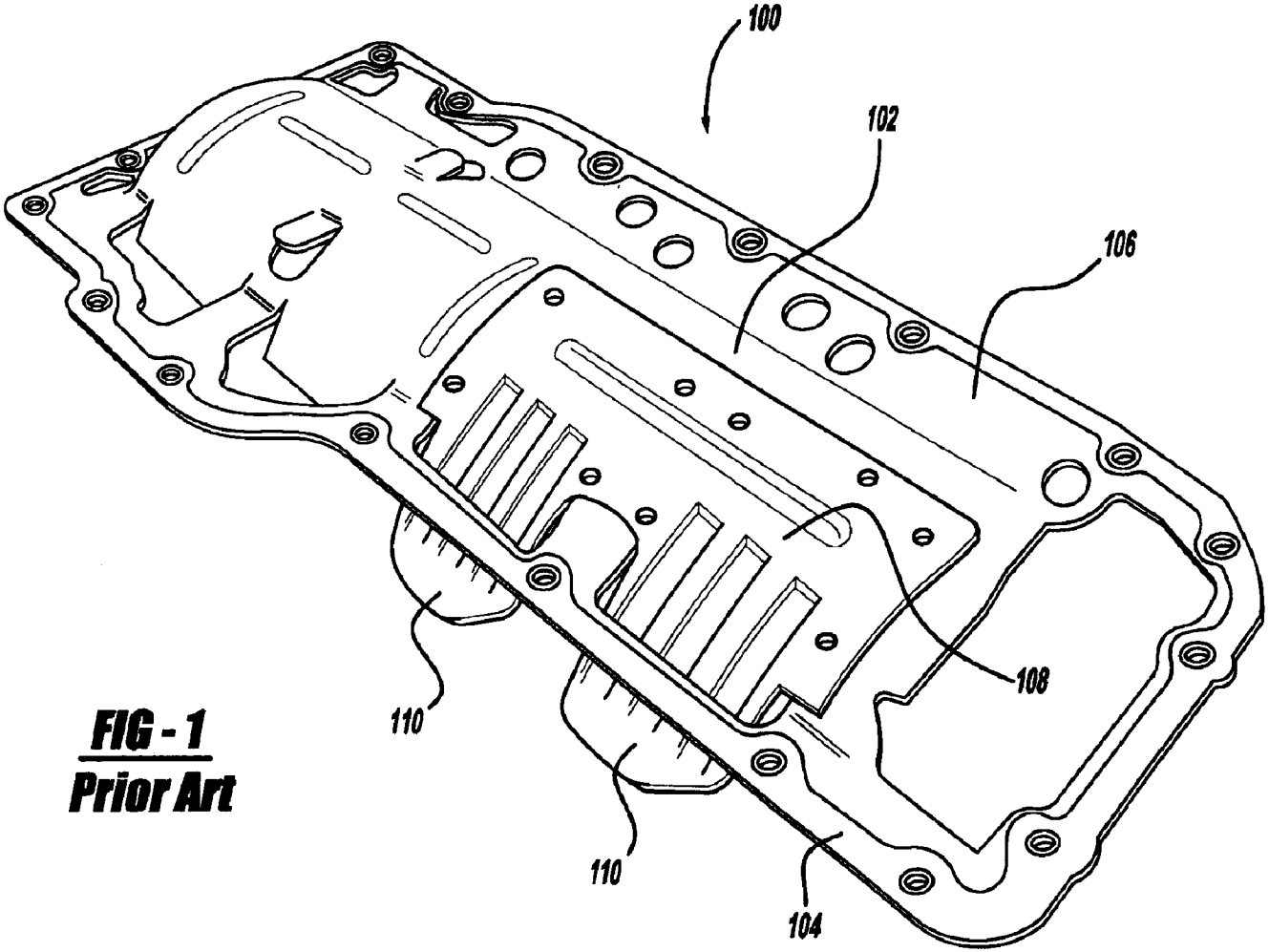
FIG - 1 Prior Art
FIG. 1 is a bottom perspective view of the oil pan gasket and windage tray according to the prior art design.
Figure 2:
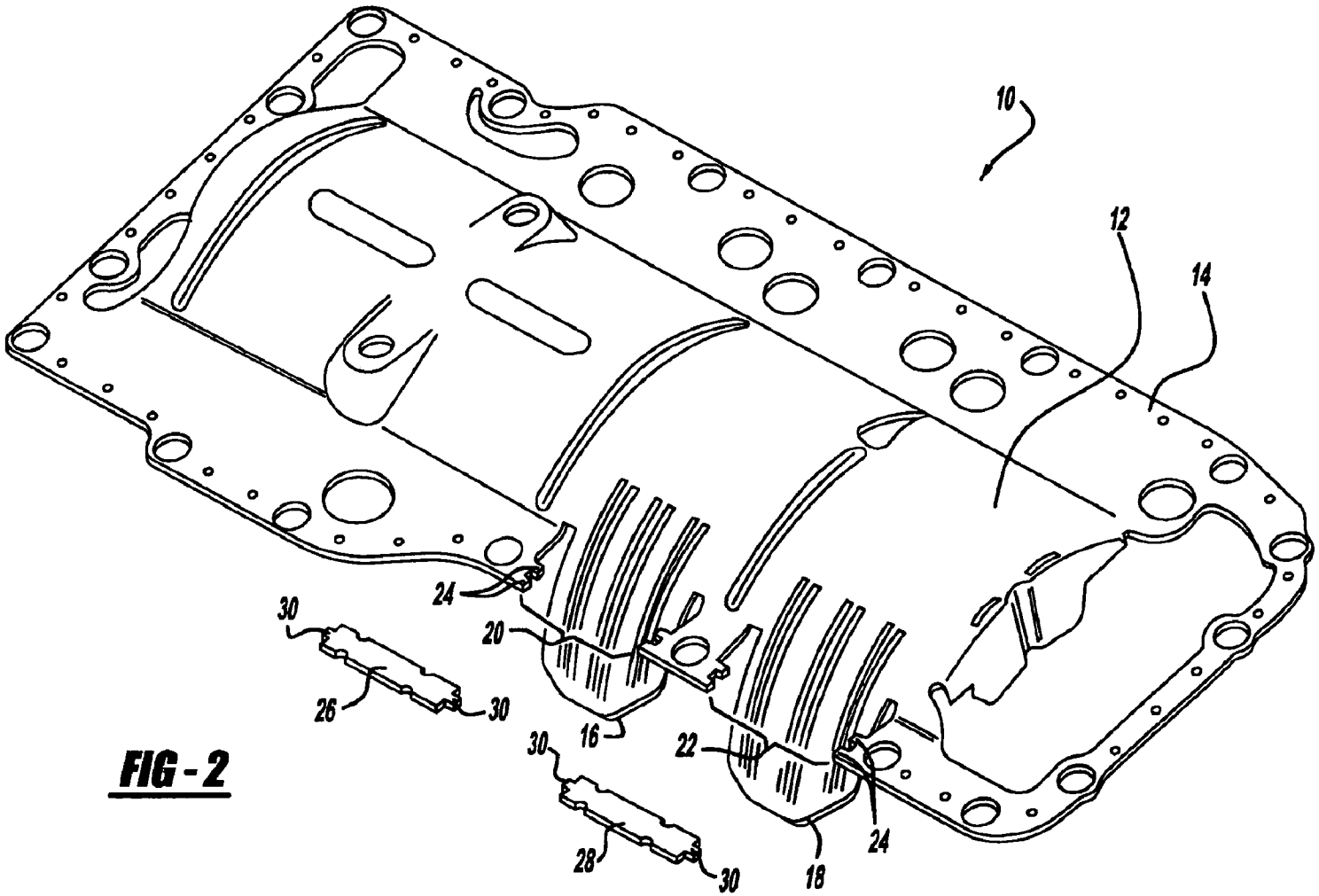
FIG. 2 is an exploded bottom perspective view of the combined oil pan gasket/windage tray design according to the principles of the present invention with separate peripheral flange portions being shown in a disassembled position.
Figure 3:
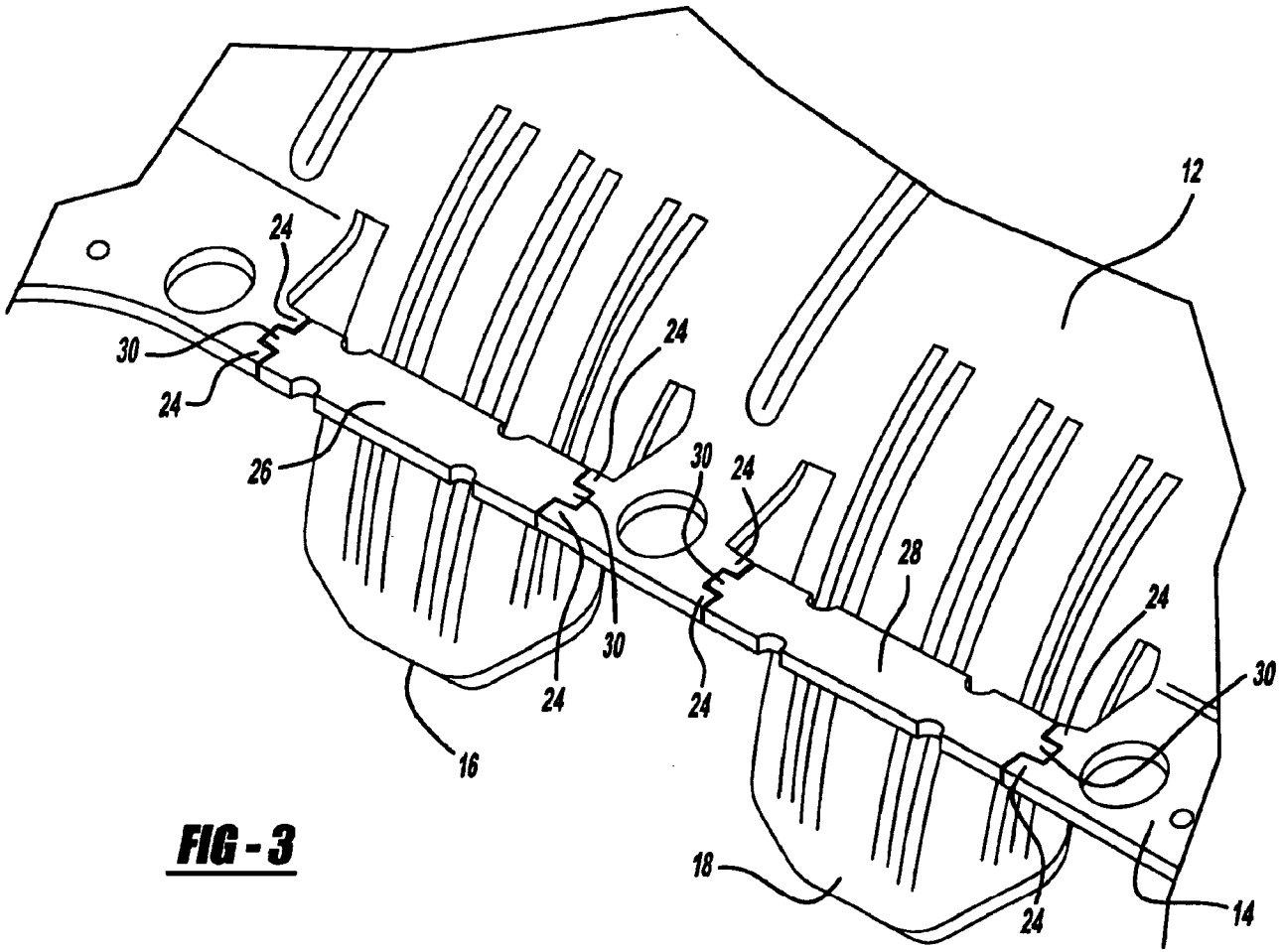
FIG. 3 is a detailed perspective view of the oil pan gasket/windage tray with the separate peripheral flange portions shown in a mounted position according to the principles of the present invention.
Figure 4:
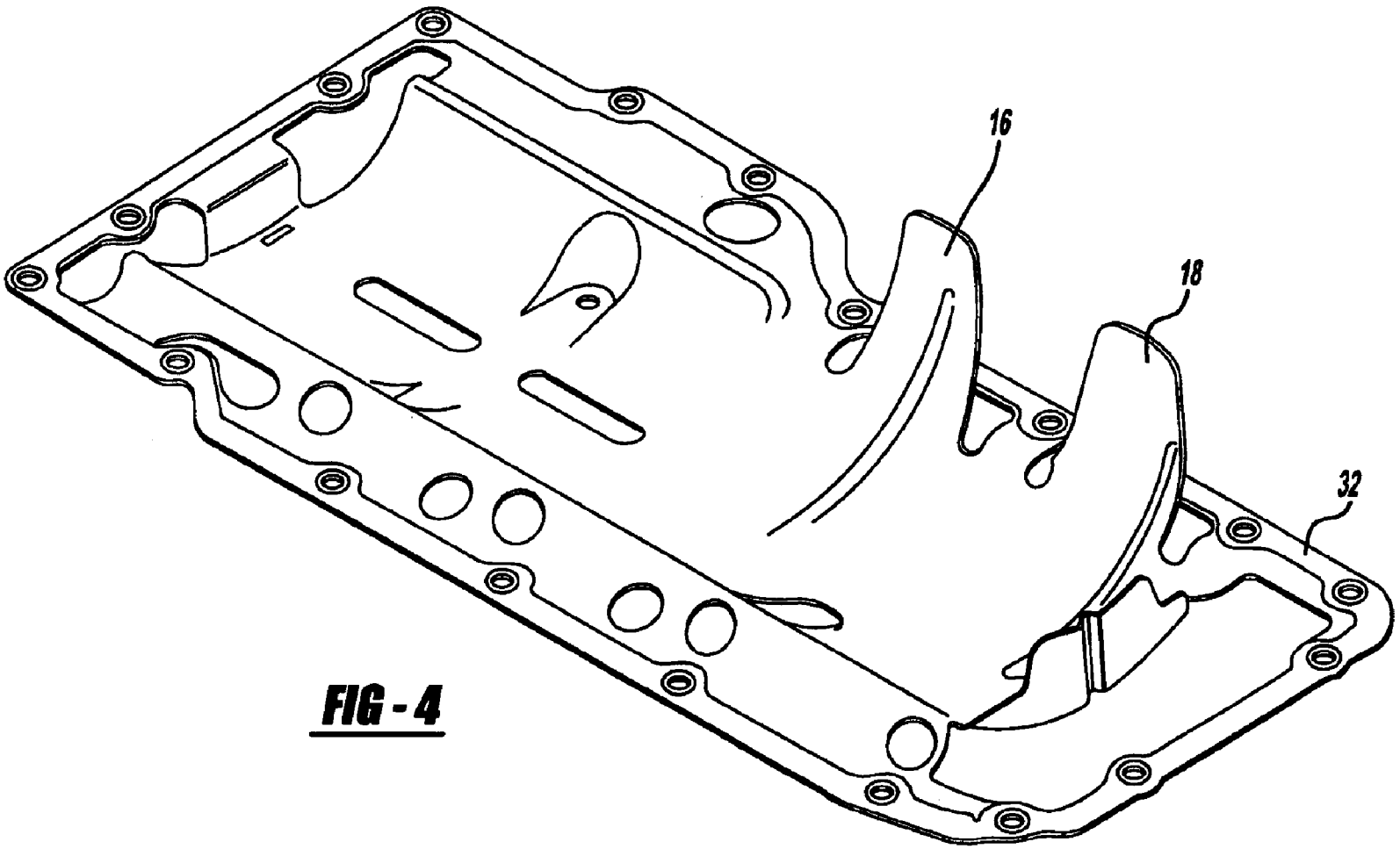
FIG. 4 is a top perspective view of the assembled oil pan gasket/windage tray according to the principles of the present invention with the elastomeric sealing bead applied thereto according to the principles of the present invention.

With reference to FIGS. 2–4, the combined oil pan gasket and windage tray 10 includes a body 12 having a peripheral flange 14 extending about the periphery of the body. A pair of deflectors 16, 18 extend away from the body 12 to a location spaced from the peripheral flange 14. The body 12 is generally semi-cylindrical in shape and may include oil drainage apertures or grooves therein. The body 12 and deflector portions 16, 18 are designed to block air and oil turbulence which is caused by rotation of a crankshaft from interacting with the air and oil which reside on the bottom of the oil pan. The body 12 including the peripheral flange portion 14 and deflector portions 16, 18 are stamped from a single sheet of metal.

The peripheral flange portion 14 of the main stamping extends around the entire periphery of the body 12 with the exception of two voids 20, 22 which are located in a vicinity of the deflector portions 16, 18, respectively. Each of the voids 20, 22 is provided with opposing fingers 24. A pair of separate peripheral flange portions 26, 28 stamped as separate pieces from the main stamping each include oppositely extending finger portions 30 which are received between fingers 24 on opposite sides of the voids 20, 22 for aligning the separate peripheral flange portions 26, 28 with the remainder of the peripheral flange portion 14.

Figure 5:
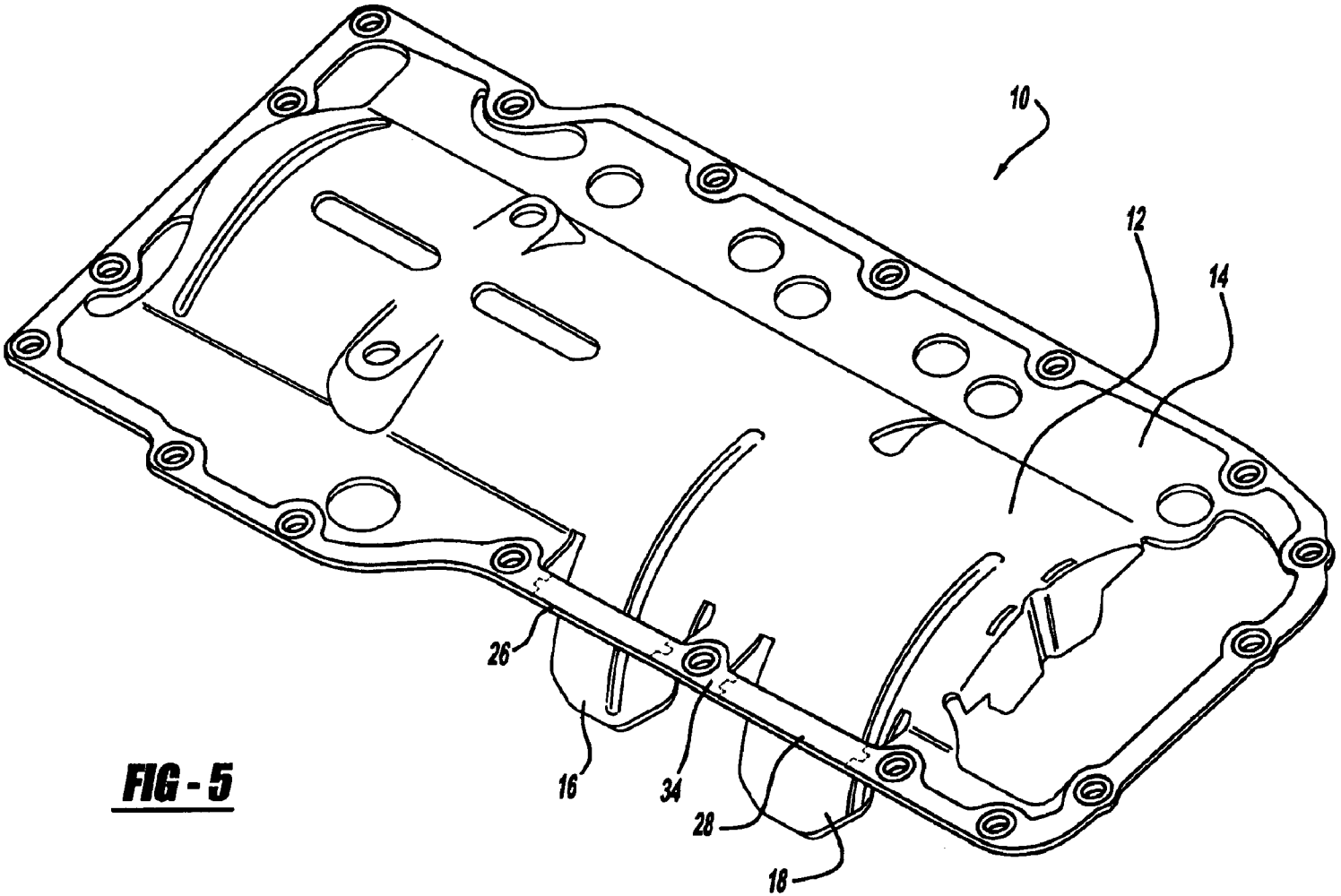
FIG. 5 is a bottom perspective view of the assembled oil pan gasket/windage tray with an elastomeric sealing bead overlying the peripheral flange according to the principles of the present invention.

With reference to FIG. 3, the separate peripheral flange portions 26, 28 are shown in an aligned generally coplanar relationship. In the final assembly, the separate peripheral flange portions 26, 28 are secured in place by applying an elastomeric sealing bead 32 (FIG. 4), 34 (FIG. 5) overlying and sealingly affixed to one or both sides of the peripheral flange portion 14 and separate peripheral flange portions 26, 28, as illustrated in FIGS. 4 and 5.

Figure 6:
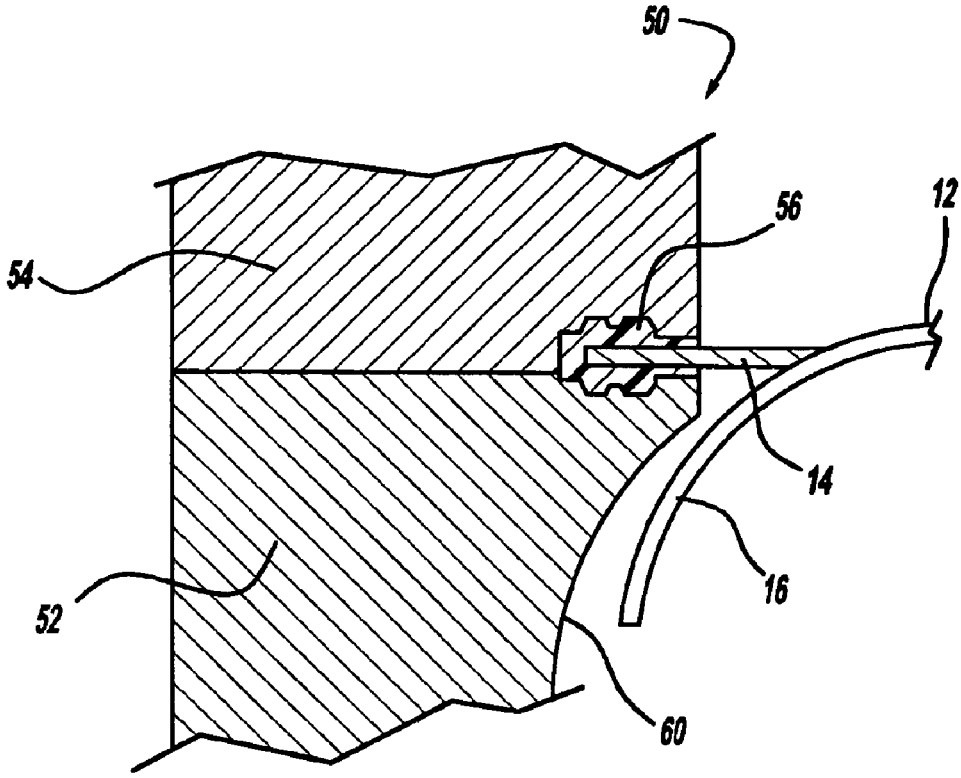
FIG. 6 is a schematic illustration of a molding apparatus for applying the elastomeric sealing bead around the perimeter of the oil pan gasket/windage tray according to the principles of the present invention.

In order to form the elastomeric sealing bead around the peripheral flange and over the separate peripheral flange portions 26, 28, a molding apparatus 50 is provided (as shown in FIG. 6) including a bottom plate 52 and a top plate 54 each defining a peripheral mold cavity 56 in which the peripheral flange 14 and separate peripheral flange portions 26, 28 are inserted such that an elastomeric material can be injection molded in order to provide an elastomeric sealing bead 32, 34 around the peripheral flange 14 and over the separate peripheral flange portions 26, 28. The elastomeric sealing bead attaches the separate peripheral flange portions 26, 28 to the remainder of the peripheral flange portion 14 in an aligned and generally coplanar relationship with the remainder of the peripheral flange portion 14. In order to accommodate the deflector portions 16, 18, which is located spaced from the peripheral flange 14, the bottom plate 52 is provided with a cutaway portion 60 which provides a clearance for the deflector portions 16, 18 so as not to interfere with the positioning of the oil pan gasket and windage tray in the molding apparatus 50 during a molding operation.

The present invention allows the deflector portions 16, 18 to be integrated into the main stamped body portion 12 and allows the peripheral flange portion 14 to be completed by a pair of simply formed separate peripheral flange portions 26, 28 which can be assembled to the main stamping 12 in a premolding stage prior to molding a rubber perimeter seal around the peripheral flange portion in order to secure the separate peripheral flange portions in place. The stamping of these separate peripheral flange portions 26, 28 or bridge members can be formed from the same sheet as the main stamping 12 and can be formed from cutaway portions or scrap portions that would otherwise not be utilized. The present invention provides a cost reduction in view of the fact that a large redundant piece of material that is used in the prior art system to create the flaps is no longer required. Furthermore, all tooling and assembly equipment related to the assembly of the extra piece to create the flaps is no longer required. Finally, the cycle time to create the entire assembly is significantly reduced because the extra operation to attach the flaps is no longer required. The final assembly weight is reduced and vibrational reaction due to the unitary construction of the main stamping is also improved.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. In a combination oil pan gasket and windage tray for an engine having an engine block and an oil pan, said tray adapted for installation between the engine block and the oil pan, said tray having a body, a peripheral flange extending about the periphery of the said body and at least one deflector portion extending away from said body to a location spaced from said peripheral flange, the improvement wherein said deflector portion is integrally formed with said body from a single piece of sheet material, at least one separate peripheral flange portion adjacent said deflector portion and being formed as a separate piece from said body and being affixed to a remainder of said peripheral flange.

2. The oil pan gasket and windage tray according to claim 1, wherein said at least one separate peripheral flange portion is affixed to said remainder of said peripheral flange by an elastomeric sealing bead overlying and sealingly affixed to at least one side of said remainder of said peripheral flange and of said separate peripheral flange portion in order to maintain said separate peripheral flange portion in an aligned and generally coplanar relationship with said remainder of said peripheral flange.

3. The oil pan gasket and windage tray according to claim 2, wherein said tray includes a second elastomeric sealing bead overlying and affixed to an opposite side of said remainder of said peripheral flange and said separate peripheral flange portion.

4. The oil pan gasket and windage tray according to claim 1, wherein said tray includes a plurality of said deflector portions, and a plurality of said separate peripheral flange portions.

5. A method of making a combination oil pan gasket and windage tray for an engine, said tray being adapted to be installed between an oil pan and an engine block, said method comprising:

forming a body of said tray from a single piece of sheet material, said body having a peripheral flange extending about the periphery thereof and at least one deflector portion extending away from said body to a location spaced from said peripheral flange; and mounting at least one separate peripheral flange portion adjacent said deflector portion, said separate peripheral flange portion being formed from a separate piece of sheet material.

6. The method of claim 5, further including applying an elastomeric sealing bead overlying and sealingly affixed to at least one side of said separate peripheral flange portion and of the remainder of said separate peripheral flange portion in order to attach said separate peripheral flange portion to said remainder of said peripheral flange portion in an aligned and generally coplanar relationship with said remainder of said peripheral flange portion.

7. The method of claim 6, further including applying a second elastomeric sealing bead overlying and sealingly affixed to an opposite side of said remainder of said peripheral flange portion and of said separate peripheral flange portion.

8. The method of claim 5, further including forming a plurality of said deflector portions and mounting a plurality of said separate peripheral flange portions adjacent said plurality of deflector portions.

9. The method of claim 6, further including placing said body of said tray and said separate flange portion in a molding apparatus and forming said elastomeric sealing bead on said separate peripheral flange portion and on said remainder of said peripheral flange portion in said molding apparatus.

10. The method of claim 9, further including providing a cut-away portion of said molding apparatus in order to provide clearance for said deflector portion.

* * * * *